United States Patent [19]

Witschi

[11] Patent Number: 4,578,916

[45] Date of Patent: Apr. 1, 1986

[54] CONNECTING AND PRESSURE-DISTRIBUTING ELEMENT FOR CONCRETE STRUCTURAL MEMBERS

[75] Inventor: Heinz Witschi, Bern, Switzerland

[73] Assignee: Peter Fankhauser, Switzerland

[21] Appl. No.: 590,371

[22] Filed: Mar. 16, 1984

[30] Foreign Application Priority Data

Mar. 16, 1983 [CH] Switzerland ..... 1458/83

[51] Int. Cl.[4] ..... E04B 1/62

[52] U.S. Cl. ..... 52/396; 52/699; 404/60

[58] Field of Search ..... 52/677, 699, 701, 396; 404/50, 51, 56, 59, 60, 61, 62, 63

[56] References Cited

U.S. PATENT DOCUMENTS

| | | | |
|---|---|---|---|
| 1,218,378 | 3/1917 | Dippel | 52/699 |
| 2,194,718 | 3/1940 | Older | 404/60 |
| 2,500,262 | 3/1950 | Parrott | 404/61 |
| 2,508,443 | 5/1950 | Carter | 404/60 |
| 4,522,531 | 6/1985 | Thomsen et al. | 404/60 X |

FOREIGN PATENT DOCUMENTS

| | | |
|---|---|---|
| 0032105 | 7/1981 | European Pat. Off. . |
| 800499 | 12/1950 | Fed. Rep. of Germany . |

*Primary Examiner*—Donald G. Kelly
*Assistant Examiner*—Creighton Smith
*Attorney, Agent, or Firm*—Wigman & Cohen

[57] ABSTRACT

The element comprises a socket and a bar slidingly insertable into the opening of the socket. Disposed around and spaced from both the socket and the bar are at least two closed loops each, of generally rectangular shape and made from reinforcing rods. The loops are secured to the socket and the bar, respectively, in one case by welding, in another case by means of a holder. Because they are symmetrically spaced from the socket and the bar, they ensure good distribution of pressure within the concrete.

11 Claims, 8 Drawing Figures

CONNECTING AND PRESSURE-DISTRIBUTING ELEMENT FOR CONCRETE STRUCTURAL MEMBERS

Figure 1:
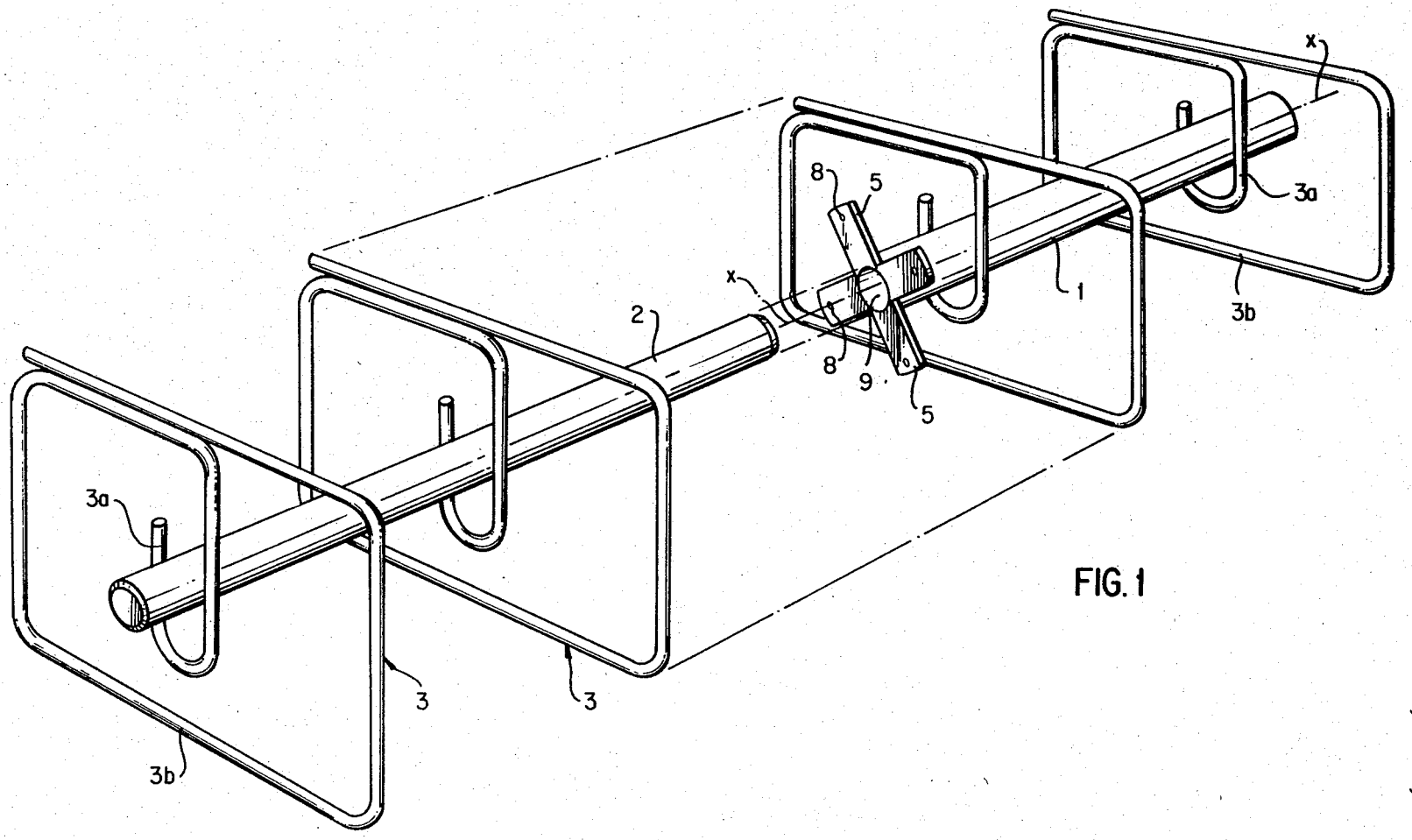

This invention relates to concrete joint construction, and more particularly to a connecting and pressure-distributing element for two structural members to be concreted one after the other in the same plane and separated by a joint, of the type having a socket and a bar insertable into the opening of the socket, the socket being intended for attachment to a frontal concrete form and for embedding in the structural member to be concreted first, and the bar inserted in the socket hole being intended for embedding in the structural member to be concreted later.

Such connecting and pressure-distributing elements are used for connecting structural members in all types of construction work, such as roof slabs, floor slabs, ceilings, walls, supports, retaining walls, highways, and the like, when such structural members are to be fixed in exactly the same plane. The structural members connected by such an element are exposed to the effects of differing temperatures, so that they expand and contract in the direction of the joint.

An element of this type consisting of a bar and a socket is described in the European patent application Publication No. 0 032 105. The socket is provided with a reinforcement and an attachment plate. The bar fitting into the socket is likewise provided with a reinforcement. These reinforcements, having a frustoconical or cylindrical outer shape, are made of an epoxy resin. The attachment plate has four holes by means of which it is attached at the time of installation to a frontal concrete form for the concrete structural member to be poured first. The bar is slidingly inserted in the opening of the socket. The point of concentration of the gravitational forces occurring between bar and socket is established exactly upon the joint between the concrete member to be poured first and the one to be poured subsequently.

By means of the reinforcements, a greater surface area is attained than that of the bar and socket sections respectively covered by the reinforcements. Owing to their more extensive surfaces, the reinforcements distribute the occurring forces over a greater area in the concrete. The larger surface obtained in this way can still not absorb the considerable gravitational forces completely, however, so that particularly the bars which transmit the forces must be made of high-grade steel. Nor can the number of elements be reduced to such an extent as would be desirable for reasons of economy.

U.S. Pat. No. 2,194,718 describes a connecting and load-transmitting device for concrete joints of a roadway. This device consists of two dowelling members, each of which is embedded in one of the concrete sections. An axially-running rod is inserted in the two dowelling members. Instead of having two identical dowelling members and a rod disposed axially therein, the rod may be made in one piece with one of the dowelling members. Each of the dowelling members is provided on the side facing the joint with a face flange and with a bearing flange made in one piece with the face flange and extending at right angles thereto.

One disadvantage of the foregoing design is that only one face flange with the bearing flange running at right angles thereto is provided on the dowelling member. The axially-running rod then has no reinforcement.

Thus, the surface area of the element is not sufficiently enlarged to be able to absorb the occurring forces completely.

It is an object of this invention to provide an improved connecting and pressure-distributing element which is so equipped that it has a much greater surface area than prior art designs.

A further object of this invention is to provide such an element of which substantially fewer need be used than is the case with the prior art devices because of the superior distribution of forces.

Still another object of this invention is to provide such an element which is much less expensive to produce than those of the prior art.

To this end, in the connecting and pressure-distributing element according to the present invention, of the type initially mentioned, at least two self-contained loops made from reinforcing rods are disposed around and spaced from both the socket and the bar, which loops are securely connected directly or indirectly to the socket and the bar.

Each loop is preferably of a spiral design, the outer end portion of the spiral forming a rectangle, and the inner end portion of the spiral being welded to the socket or the bar, as the case may be.

In another embodiment of the invention, each rectangular loop is set into a star-shaped holding device having a hub, this device being tightly forced onto the socket or the bar, as the case may be.

Figure 2:
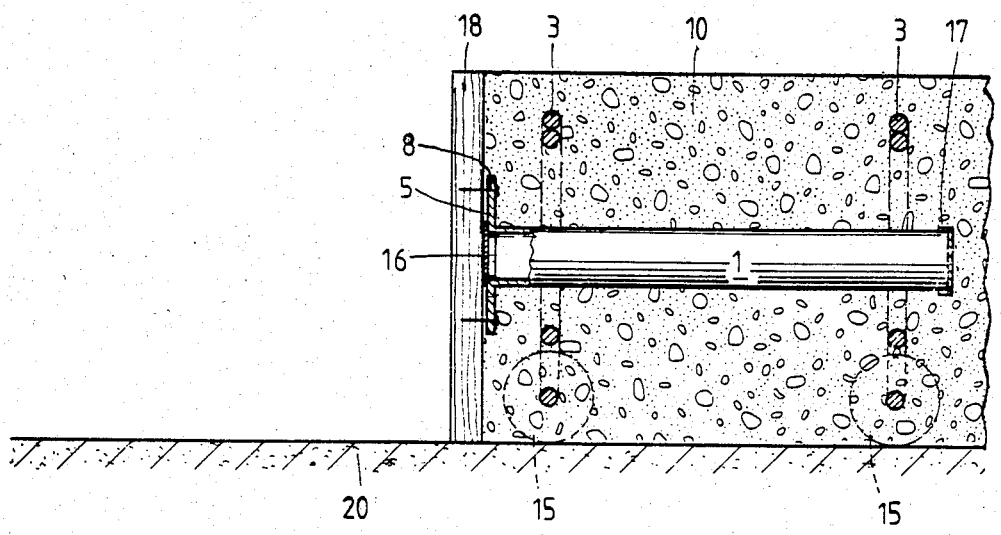
Figure 3:
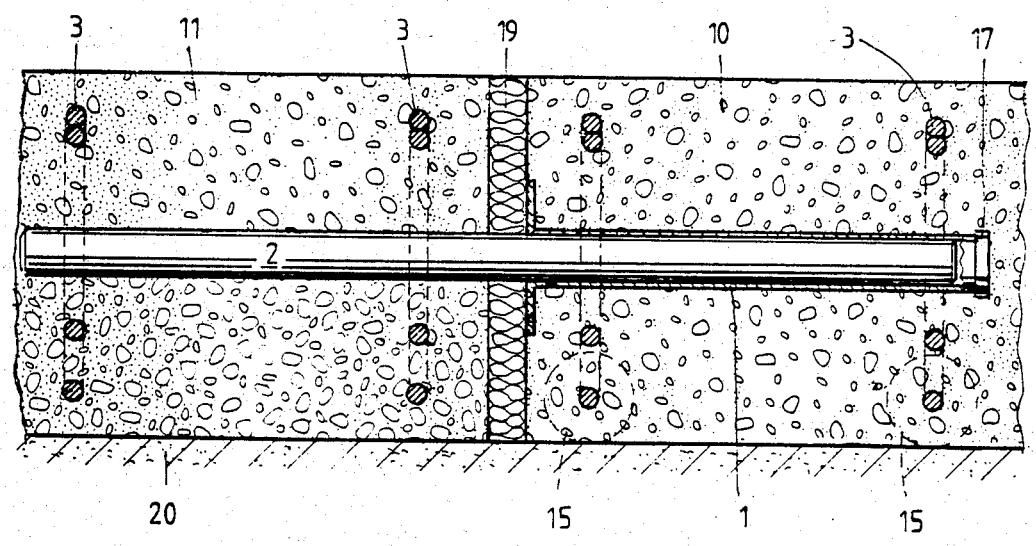
Figure 4:
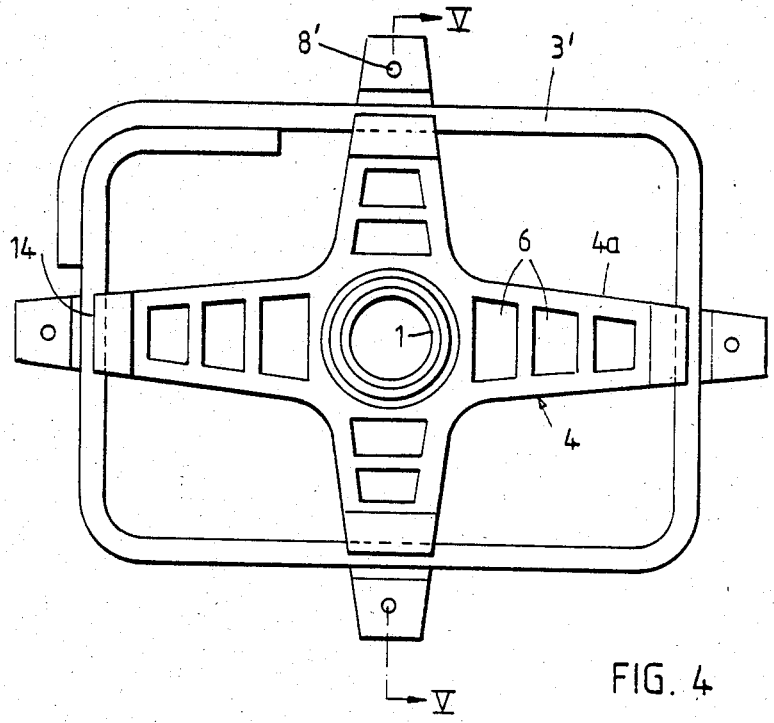
Figure 5:
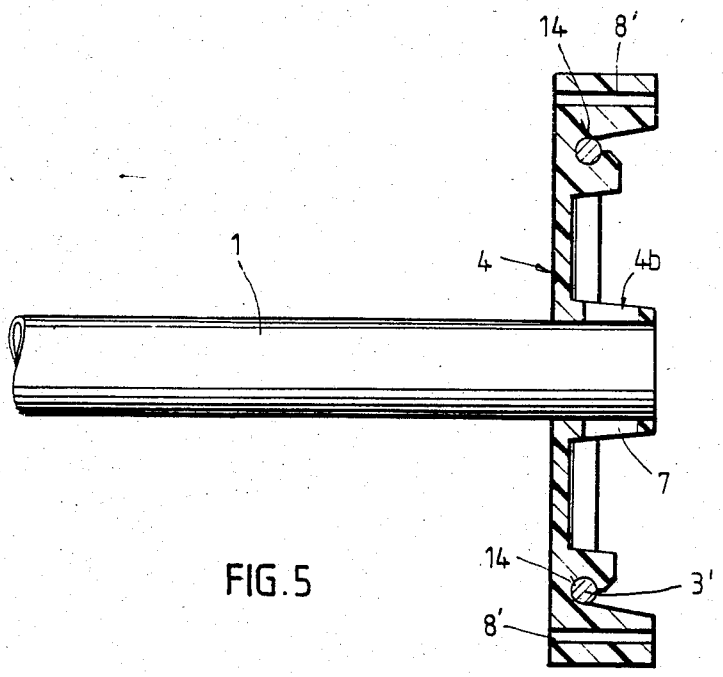
Figure 6:
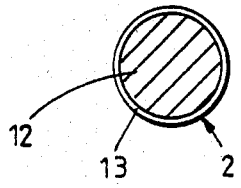
Figure 7:
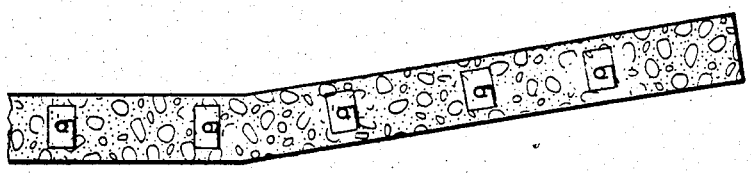
Figure 8:
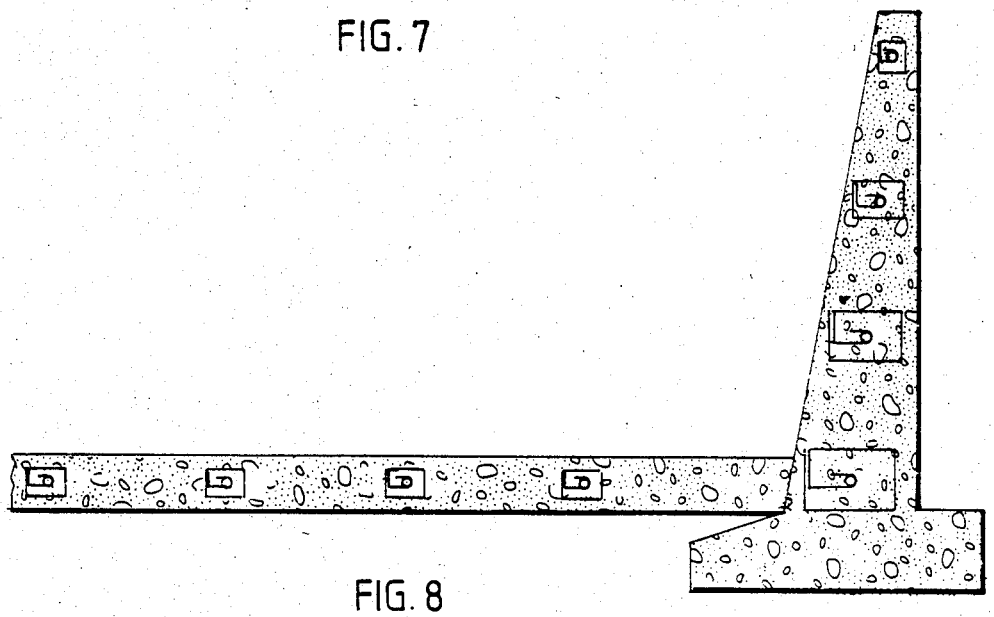

Preferred embodiments of the invention will now be described in detail with reference to the accompanying drawings, in which:

FIG. 1 is a perspective view of a connecting and pressure-distributing element according to the invention, having a socket and a bar, each of which is provided with two spiral-shaped loops, FIG. 2 is a sectional view showing the socket attached to a frontal concrete form and embedded in the concrete structural member poured first, FIG. 3 is a sectional view showing the socket embedded in the first-poured concrete member, from which the form has been removed, and the bar inserted in the socket and embedded in the subsequently-poured concrete structural member, FIG. 4 is a front elevation of the element in another embodiment, having a star-shaped holding device, FIG. 5 is a section taken on the line V—V of FIG. 4, FIG. 6 is a cross-section of the bar shown in FIG. 1, FIG. 7 is a diagrammatical sectional view through a banked-curve section of a highway with the embedded elements, and FIG. 8 is a diagrammatical sectional view through a straight-running section of a highway and an adjacent retaining wall with the embedded elements.

The element shown in FIGS. 1 to 3 is used to connect two concrete structural members 10, 11 to be poured in succession in the same plane and separated by a joint 19, as is particularly the case for highways, runways, and taxiways. The elements embedded in the structural members enable the latter to expand and contract without constraint when subjected to fluctuations in temperature. The element serves the further purpose of distributing developing forces over a larger area in the concrete.

The connecting and pressure-distributing element comprises a socket 1 and a bar 2 slidingly insertable into the opening 9 of socket 1. This socket is intended to be attached to a frontal concrete form 18 for a structural member 10 to be poured first and to be embedded in member 10. Bar 2 inserted into socket opening 9 is intended to be embedded in a structural member 11 to be poured later. Through the unhindered sliding movement of bar 2 in socket opening 9, the two concrete structural members 10 and 11 can expand and contract without constraint after casting.

Disposed around both socket 1 and bar 2, and spaced therefrom, are at least two closed loops 3 made from reinforcing rods. In the embodiment illustrated in FIGS. 1 to 3, each loop 3 is in the form of a spiral. The outer end portion 3*b* of the spiral forms a rectangle, and the inner end portion 3*a* of the spiral is welded to socket 1 or bar 2, as the case may be. Spiral-shaped loops 3 are made, for example, of reinforcing steel having a diameter of 6 to 12 mm and are rapidly wound on an automatic machine into a spiral as shown in FIG. 1. The outer end portion 3*b* of the spiral is welded to the overlapping middle portion of the spiral. Thus, there is produced a closed loop of rectangular form which is permanently fixed to socket 1 or bar 2 and spaced therefrom. The loops can be quickly and accurately produced on the automatic machine in whatever size is desired at a production rate of about 500 loops per hour.

Turning now to FIGS. 2 and 3, it will be seen that because of the rectangular shape of loops 3, they can be placed on the foundation (e.g., a layer of lean concrete 20) either lying on one of their long sides or standing upright on one of their short sides. The spacing between socket 1 or bar 2 and the foundation can thereby be changed as desired. In order to obtain an even more precise adjustment of the height of socket 1 from the foundation, at least two circular spacers 15 of plastic material may be placed on the outer end portion 3*b* of the spiral of each loop 3 associated with socket 1. Such spacers are commercially available in various diameters.

Socket 1 is slit at the end to be situated adjacent to frontal form 18 in order to form several tongues 5. These tongues are each provided with a hole 8 for nailing tongues 5 to form 18 for structural member 10 to be poured first.

In order to keep the fluid concrete from getting into socket 1 during the pouring of first structural member 10, a plastic plug 16 is placed on the end of socket 1 nearest form 18, and the other end is provided with a plastic cap 17.

After the first-poured structural member 10 has set, form 18 is removed, and plug 16 is taken out of socket 1. Bar 2 is then inserted into opening 9 of socket 1, whereupon loops 3 of bar 2 take on the desired spacing from the loops of socket 1, and joint 19 is filled with insulating material. After the second structural member 11 has set, the connection is established.

In another embodiment, depicted in FIGS. 4 and 5, each loop 3' of rectangular shape is set in the arms 4*a* of a star-shaped plastic holding device 4 having a hub 4*b*. Reinforcing loops 3' in this embodiment differ from those of the embodiment illustrated in FIGS. 1 to 3 in that they are not bent into a spiral. Instead they take the form of a simple rectangle, with the end portions partially overlapping and welded together. Arms 4*a* and hub 4*b* are perforated in order to permit the fluid concrete to penetrate through holes 6, 7 and thus to achieve better adhesion.

Each rectangular loop 3' is set into recesses 14 in arms 4*a*, and holder 4 is mounted fast on socket 1 or bar 2. There is a hole 8' at the end of the arms 4*a* for nailing the holder 4 mounted on socket 1 to frontal concrete form 18 (FIG. 2). This embodiment is used for elements of smaller dimensions.

Here, too, spacers 15 may be mounted on loops 3' of socket 1 in order to adjust the height of socket 1 from the foundation or the form as may be desired.

Bar 2, which is subjected to the greatest loads by the forces that develop, is made of high-quality steel in prior art designs, also to avoid the effects of corrosion. According to the present proposal, bar 2 comprises a core 12 of structural steel, over which a tubular shell 13 of high-grade steel is pressed on (FIG. 6). This design represents a considerable saving. Bar 2 may be from 16 to 40 mm in diameter and must match the diameter of opening 9 of socket 1.

The connecting and pressure-distributing element described above is produced complete at the factory. At the construction site, it is merely adjusted to the desired height and assembled. Assembly is very simple. The loops of the element lie at their predetermined places without any movement at all, and the socket and bar retain their horizontal position at the desired height. The socket can no longer move downward during mounting of the heavy reinforcement. By means of the loops symmetrically spaced from the socket and the bar, a better distribution of the pressure is achieved.

What is claimed is:

1. A connecting and pressure-distributing element for two concrete structural members to be poured in succession in the same plane and separated by a joint, comprising:

a socket portion intended to be attached to a frontal concrete form and to be embedded in the first-poured of said two concrete structural members;

a bar insertable in said socket portion and intended to be embedded in the second-poured of said two concrete structural members;

a plurality of closed loops made from reinforcing rods, at least two said loops being disposed around and spaced from said socket portion, at least two said loops being disposed around and spaced from said bar, said loops being respectively secured to said socket portion and said bar.

2. The element of claim 1, wherein each of said loops is shaped as a spiral having an outer end portion and an inner end portion, said outer end portion forming a rectangle, and said inner end portion being welded to said socket portion or said bar.

3. The element of claim 1, further comprising a plurality of star-shaped holding devices each including a plurality of arms and a hub, wherein each of said loops is shaped as a rectangle and is set into said arms of an associated one of said holding devices, said holding devices being fixed to said socket portion and said bar, respectively.

4. The element of claim 3, wherein said arms and said hub of each of said holding devices are perforated, each of said arms further including a hole at the end thereof remote from said hub.

5. The element of claim 3, wherein said holding devices are made of a synthetic material.

6. The element of claim 1, further including a plurality of tongues situated at one end of said socket portion and extending at right angles to the longitudinal axis thereof, each of said tongues including a hole at the end thereof remote from said socket portion for nailing said tongues to said frontal concrete form associated with said first-poured of said two concrete structural members.

7. The element of claim 1, wherein said bar comprises a core of structural steel and a tubular shell of high-grade steel surrounding said core and secured thereto.

8. A connecting and pressure-distributing element, comprising:

a longitudinally extending socket portion being open at a first end and closed at a second end;

flange means extending from the first end of the socket portion, said flange means being flush with the first end and extending perpendicularly from the longitudinal direction of the socket portion;

longitudinally extending bar means insertable in said socket portion in an axially adjustable means;

loop means having an outer portion and an inwardly extending inner portion, a plurality of said loop means being secured to the socket portion and a plurality of said loop means being secured to the bar means, said loop means being secured by attaching the inner portion thereof to the respective socket portion and bar means such that the loop means extends substantially perpendicular to the longitudinal direction of the socket portion and bar means.

9. The connecting and pressure distributing element of claim 8, wherein the flange means comprise a plurality of rectangular tongues have bores therethrough.

10. The connecting and pressure distributing element of claim 8, further comprising means connected to the outer portion of the loop means for spacing the loop means from a substructure.

11. The connecting and pressure distributing element of claim 8, further comprising means for fastening the flange means to a form for pouring concrete around said socket portion.

* * * * *